US006246398B1

(12) United States Patent
Koo

(10) Patent No.: US 6,246,398 B1
(45) Date of Patent: Jun. 12, 2001

(54) APPLICATION SPECIFIC INTEGRATED CIRCUIT (ASIC) FOR DRIVING AN EXTERNAL DISPLAY DEVICE

(75) Inventor: Si-Gyung Koo, Seoul (KR)

(73) Assignee: Hyundai Electronics Industries Co., Ltd., Ichon (KR)

( * ) Notice: Subject to any disclaimer, the term of this patent is extended or adjusted under 35 U.S.C. 154(b) by 0 days.

(21) Appl. No.: 09/103,575

(22) Filed: Jun. 24, 1998

(30) Foreign Application Priority Data

Dec. 15, 1997 (KR) ..... 1997-68800

(51) Int. Cl.[7] ..... G09G 5/00
(52) U.S. Cl. ..... 345/204
(58) Field of Search ..... 345/204, 211, 345/212, 73

(56) References Cited

U.S. PATENT DOCUMENTS 5,030,856 * 7/1991 Dansky et al. ..... 307/475
5,309,151 * 5/1994 Aoki ..... 345/211
5,406,312 * 4/1995 Arimoto ..... 345/211
5,532,718 * 7/1996 Ishimaru ..... 345/211

* cited by examiner

*Primary Examiner*—Richard Hjerpe
*Assistant Examiner*—Ronald Laneau
(74) *Attorney, Agent, or Firm*—Fleshner & Kim, LLP

(57) ABSTRACT

A display apparatus is provided that enables an output of an application specific integrated circuit (IC) to be externally displayed without an additional driving device or an interface coupled to the additional driving device. The external display apparatus for an application specific IC includes an application specific integrated circuit, a converting unit disposed in the application specific integrated circuit for converting a two-level signal outputted from the application specific integrated circuit to a plurality of four(or more)-level signals, and a display unit for externally displaying respective output values of the converting unit.

18 Claims, 4 Drawing Sheets

APPLICATION SPECIFIC INTEGRATED CIRCUIT (ASIC) FOR DRIVING AN EXTERNAL DISPLAY DEVICE

BACKGROUND OF THE INVENTION

1. Field of the Invention

The present invention relates to a technology for externally displaying an output of an application specific Integrated Circuit (ASIC), and more particularly to a display apparatus having an application specific IC.

2. Background of the Related Art

FIG. 1 is a block diagram illustrating a related art external display apparatus for an application specific IC. As shown in FIG. 1, the related art external display apparatus for an application specific IC includes an application specific IC (ASIC) 1, a driving unit 2 for outputting a driving signal OUT in accordance with a signal INTERFACE received from the application specific IC 1, and a display unit 3 formed of a seven-segment Liquid Crystal Display (LCD) or Dot Matrix Liquid Crystal Display(LCD) for externally displaying a value that corresponds to an output signal OUT of the driving unit 2.

The signal INTERFACE outputted from the application specific IC 1 is a two-level (high and low) signal. The driving unit 2 converts the two-level signal INTERFACE to a multi-level signal OUT. The respective wave forms of the signals INTERFACE, OUT are shown in FIGS. 2A and 2B. The display unit 3 then externally displays the resultant output of the application specific integrated circuit 1 in accordance with the signal OUT.

The application specific IC 1 outputs a signal of a high or low level. However, the display unit 3 including the LCD or the like requires a multi-level signal. Therefore, to externally display the resultant value of the application specific IC 1 using the display unit 3 formed of LCD requires a provision of the driving unit 2 to drive the display unit 3. As illustrated in FIG. 1, the driving unit 2 is formed of an additional semiconductor chip.

The related art external display apparatus for an ASIC has various disadvantages. The external display apparatus for an application specific integrated circuit 1 includes additional devices to drive the LCD, such as the driving unit 2, which increases production cost and circuit area. Further, the application specific integrated circuit 1 requires additional hardware and software to interface with the driving unit 2.

SUMMARY OF THE INVENTION

An object of the present invention is to provide a display apparatus for an application specific IC that substantially solves at least one of the above-described problems and disadvantages of the related art.

Another object of the present invention is to reduce production cost.

A further object of the present invention is to reduce circuit area.

A further object of the present invention is to eliminate additional hardware and/or software.

Another object of the present invention is to add a device inside the application specific IC to generate data to display a resultant value in a display unit.

A further object of the present invention is to provide a display apparatus for externally displaying an output for an application specific IC that uses additional devices including resistors and three-phases buffer in the application specific IC.

To achieve at least the above-described objects in a whole or in parts, there is provided a display apparatus according to the present invention that includes an application specific integrated circuit (ASIC) having an integrated circuit and a converting unit that converts a two-level signal outputted from the integrated circuit to a plurality of four-level signals by controlling a current flow and a display unit that displays respective output values of the ASIC based on the plurality of multi-level signals.

The present invention may be achieved in a whole or in parts by an application specific integrated circuit (ASIC) according to the present invention that includes an integrated circuit formed in a first semiconductor chip that performs a prescribed function; and a converting unit disposed in the integrated circuit that receives a first signal and a plurality of second signals outputted from the integrated circuit and outputs one of (a) the output signal of the integrated circuit and (b) a fraction of the output signal.

The present invention may be achieved in a whole or in parts by a display driving apparatus for an application specific integrated circuit according to the present invention that includes a first signal and a plurality of second signals output by the application specific integrated circuit; a logic-gate that logically processes the first signal; and a plurality of converters respectively coupled in parallel to the logic-gate to form a plurality of current paths, wherein each of the plurality of converters receive the first signal, and wherein current flow in a selected current path can be reversed based on the output signal of the integrated circuit.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Figure 1:
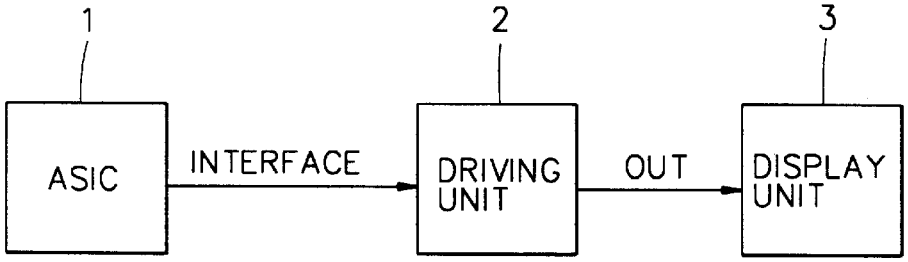
FIG. 1 BACKGROUND ART
FIG. 1 is a block diagram illustrating a related art external display apparatus for an application specific integrated circuit.
Figure 2A:
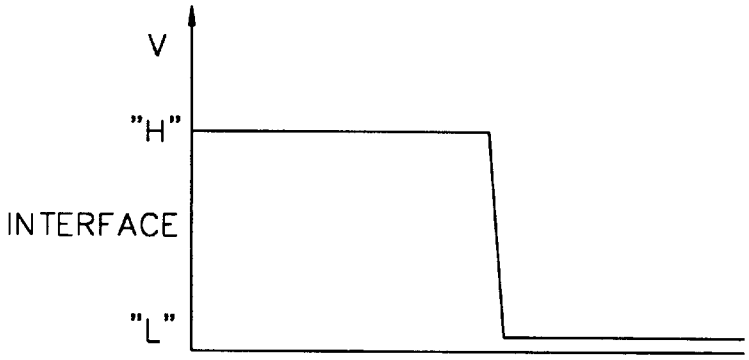
FIG. 2A BACKGROUND ART
FIGS. 2A and 2B are diagrams illustrating timing waveforms of signals input and output from a driving unit in the apparatus of FIG. 1.
Figure 2B:
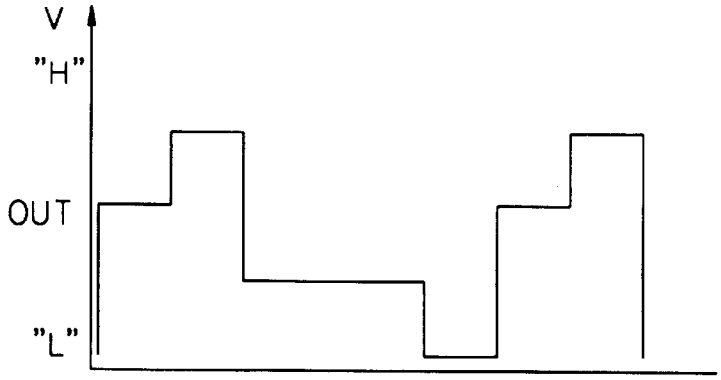
FIG. 2B BACKGROUND ART
Figure 3:
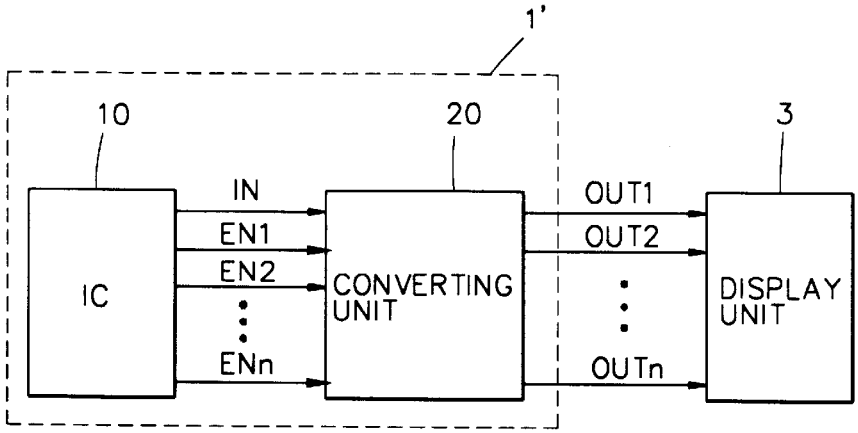
FIG. 3 is a block diagram illustrating an external display apparatus for an application specific integrated circuit according to a preferred embodiment of the present invention.

FIG. 3 is a block diagram illustrating a preferred embodiment of a display apparatus according to the present invention. The preferred embodiment includes an application specific integrated circuit 1' and an external display unit 3.

The ASIC 1' includes integrated circuit 10 and a converting unit 20 that converts a signal IN outputted from the integrated circuit 10 to a plurality of four-level output signals OUT1~OUTn in accordance with a plurality of enable signals EN1~ENn. The display unit 3 is driven by the output signals OUT1~OUTn.

The integrated circuit 10 and the display unit 3 are similar to those of the related art. Accordingly, a detailed explanation is omitted. The converting unit 20 is separated from the specific integrated circuit 10 in FIG. 3 for ease of explanation, however, it is integrated inside integrated circuit 10 of the application specific integrated circuit 1' on a single clip in an actual circuit.

Figure 4:
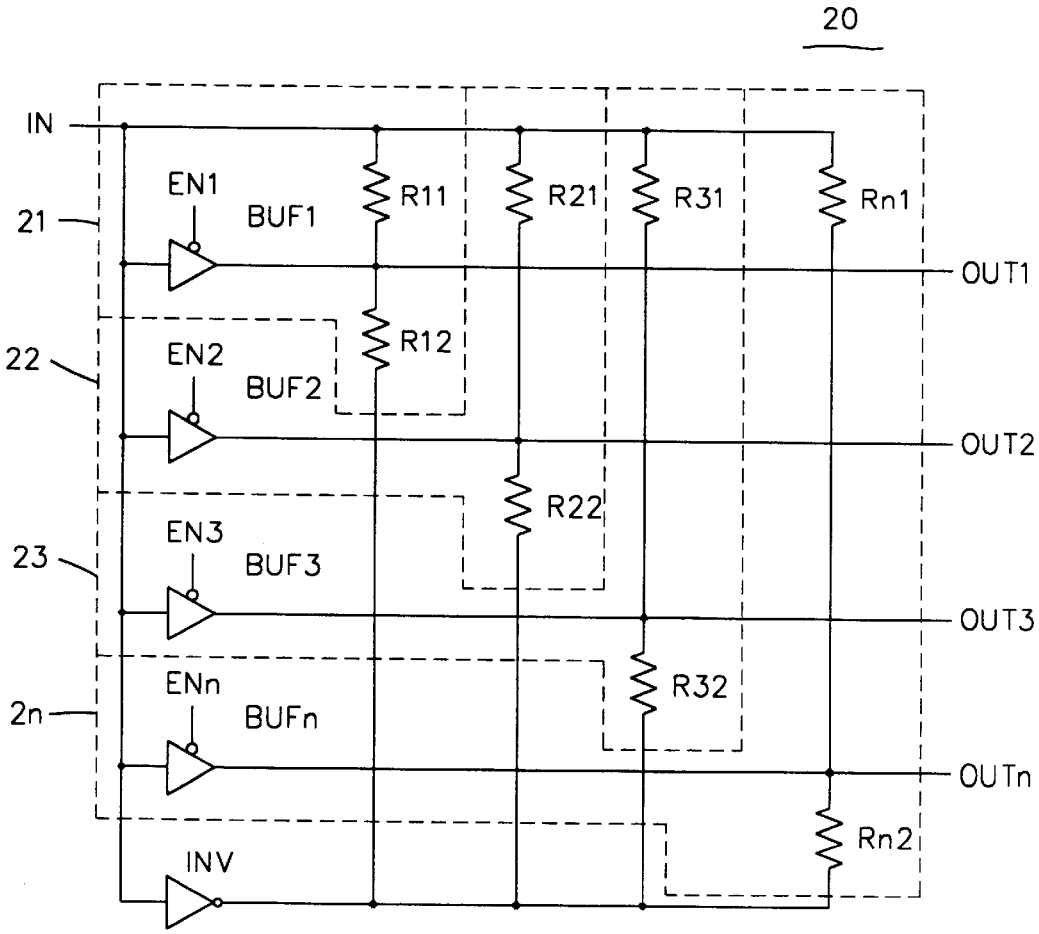
FIG. 4 is a block diagram illustrating a converting unit in FIG. 3.

FIG. 4 is a circuit diagram showing the converting unit 20. The converting unit 20 includes an inverter INV for inverting the signal IN outputted from the integrated circuit 10 and first to nth converters 21~2*n* coupled parallel to the inverter INV. The first to nth converters 21~2*n* respectively receive the enable signals EN1~ENn from the integrated circuit 10 and determine respective logic states of output signals OUT1~OUTn, which are to be applied to the display unit 3, based on the logic states of the signals IN and EN1~ENn.

The first converter 21 includes a buffer BUF1 for transferring or interrupting the input signal IN in accordance with the enable signal EN1. The first converter 21 further includes a pair of resistances R11, R12 coupled parallel to the inverter INV. A common contact node of the pair of resistances R11, R12 is coupled to an output terminal of the buffer BUF1, which is to be coupled to the display unit 3. Compositions of the second to nth converters 22~2*n* with regard to buffers BUF2~BUFn and pairs of resistances (e.g., resistors) (R21, R22)~(Rn1, Rn2) are similar to that of the first converter 21. Accordingly, a detailed description is omitted.

Operations of the preferred embodiment of external display apparatus for an application specific integrated circuit according to the present invention will now be described. The signal IN applied from the integrated circuit 10 to the converting unit 20 is converted to the plurality of four-level signals OUT1~OUTn based on the logic state of the plurality of enable signals EN1~ENn . The inverter INV in the converting unit 20 inverts the logic state of the signal IN, and the buffers BUF1~BUFn are respectively enabled when the enable signals EN1~ENn are respectively in a low state.

Operations of the converting unit 20 will be described based on the logic states of the signal IN and the enable signals EN1~ENn. When the signal IN is in a high level and the enable signal EN1 is in a low level, the buffer BUF1 is enabled, and the output signal OUT1 outputted from the buffer BUF1 to the display unit 3 remains in a high level.

When the signal IN is in a high level and the enable signal EN1 is also in a high level, the buffer BUF1 is disabled, and the output terminal of the inverter INV is turned to a low level. At this time, a current path with regard to the signal IN becomes resistance R11→resistance R12→inverter INV. The voltage of the signal IN is divided by the pair of the resistances R11, R12, and a voltage level of the signal OUT1 outputted from the buffer BUF1 depends on respective values of the resistances R11, R12. The voltage level of the signal OUT1 can be determined by equation 1 assuming H is a prescribed positive voltage and L is approximately zero voltage.

$$\frac{R12}{R11+R12}+H \tag{1}$$

When the signal IN is in a low level and the enable signal EN1 is in a low level, the buffer BUF1 is enabled, and the output signal OUT1 outputted from the buffer BUF1 to the display unit 3 remains in a low level. When the signal IN is in a low level and the enable signal EN1 is in a high level, the buffer BUF1 is disabled, and the output terminal of the inverter INV is turned to a high level. At that time, a current path with regard to the signal IN become a reverse order to that inverter INV→R12→R11. Thus, the current path is a reverse order to that when the signal IN and the enable signal EN1 are high level. The voltage of the signal IN is divided by the pair of the resistances R11, R12, and a voltage level of the signal OUT1 outputted from the buffer BUF1 depends upon respective values of the resistances R11, R12 based on equation 2.

$$\frac{R11}{R11+R12}+H \tag{2}$$

Figure 5A:
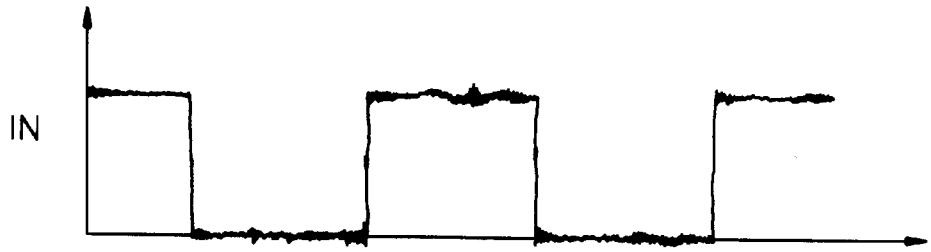
FIGS. 5A through 5C are diagrams illustrating timing waveforms of respective signals with regard to a first converter in FIG. 4.
Figure 5B:
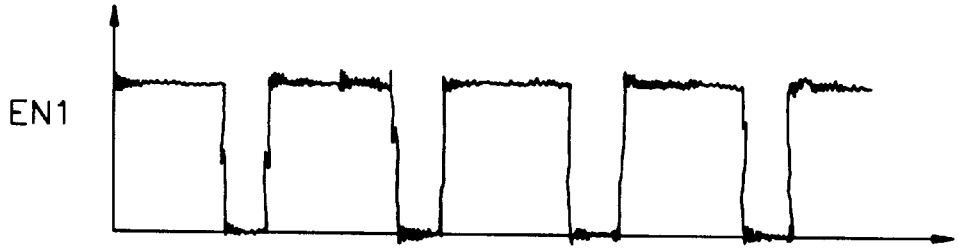
Figure 5C:
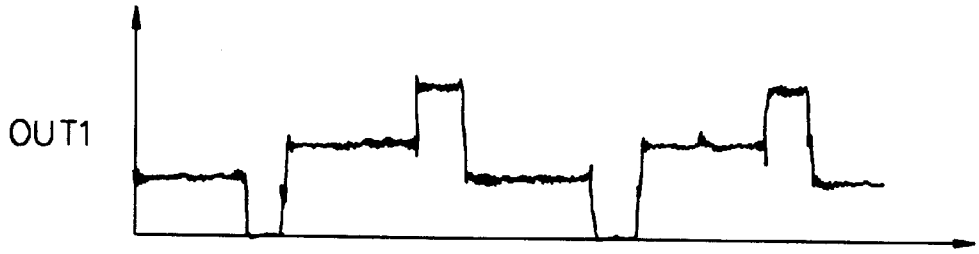

In accordance with the respective logic states of the signal IN and the enable signal EN1 and the values of the resistances R11, R12, the output signal OUT1 of the first converter 21 is provided with four logic states. The four logic states of the output signal OUT1 are shown in Table 1. FIGS. 5A through 5C are diagrams illustrating the signals IN, EN1, OUT1 timing waveforms in the first converter 21.

TABLE 1

| IN | EN1 | OUT1 |
|---|---|---|
| H | L | H |
| H | H | $\frac{R12}{R11+R12}+h$ |
| L | L | L |
| L | H | $\frac{R11}{R11+R12}+h$ |

When the two resistances R11, R12 are equal, the respective voltage values represented in equations 1 and 2 with regard to the output signal OUT1 also become equal. In this case, the output signal OUT1 indicates three logic states (e.g., levels). Operations of the remaining second to nth converters 22~2*n* are similar to that of the first converter 21. Thus, a detailed description is omitted.

The plurality of converters shown in FIG. 4 are an exemplary embodiment of the converting unit 20. However, the present invention is not intended to be so limited. For example, additional converting circuits that generate an output signal for a display unit that can be incorporated into an application specific IC can also be used.

Figure 6:
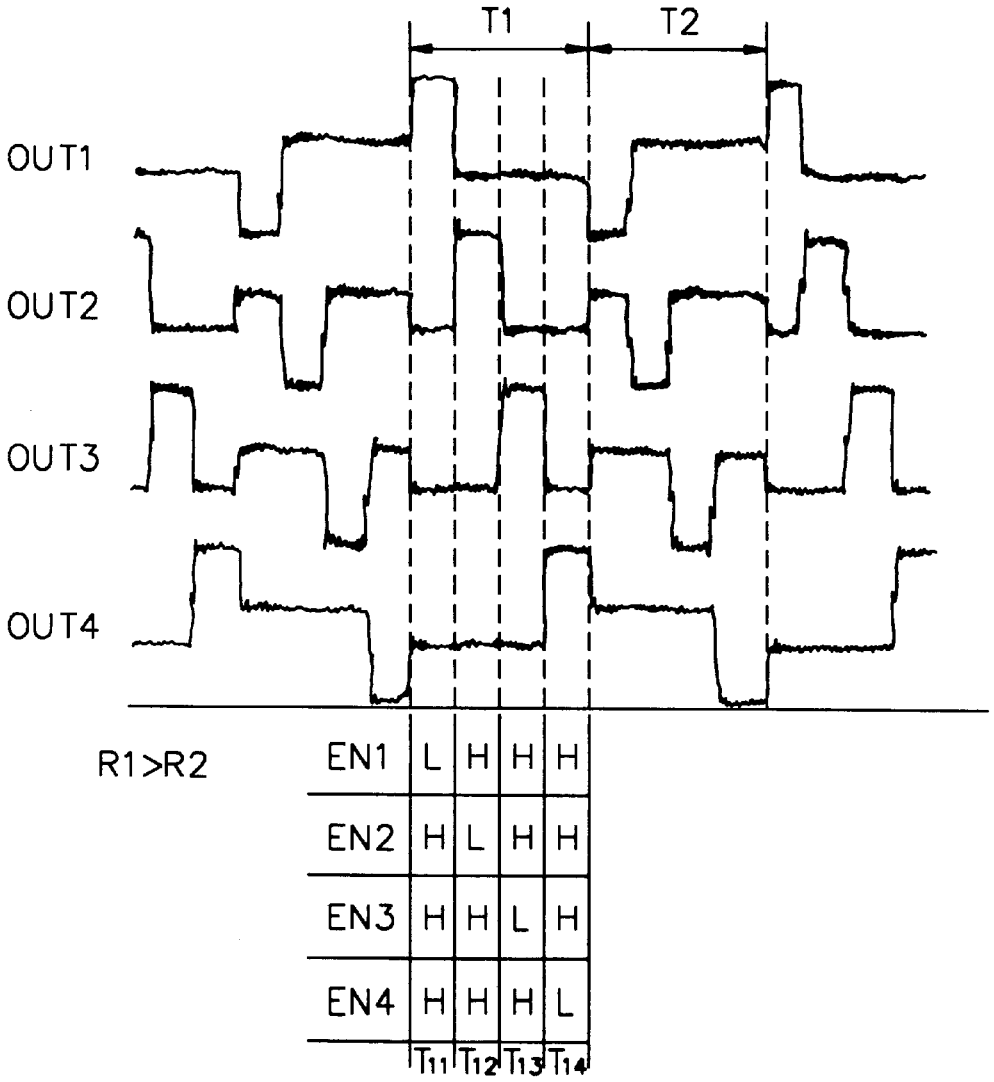
FIG. 6 is a diagram illustrating composite timing waveforms of signals of converters in the circuit of FIG. 4.

FIG. 6 is a diagram illustrating output signals of the first converter 21 in accordance with enable signals. In FIG. 6, the resistance R11 is larger than resistance R12 in value, the signal IN is in a high level at time interval T1 and the signal IN is in a low level at time interval T2. Also, the logic states of the enable signals EN1~EN4 are identified for time intervals T11, T12, T13, T14 of the time interval T1.

As described above, the preferred embodiment of the external display apparatus has various advantageous. The preferred embodiment of external display apparatus for an application specific integrated circuit according to the present invention provides a multi-level output signal with regard to the signal outputted from the application specific integrated circuit without an extra driving circuit by adding a less complex circuit in the application specific integrated circuit. Further, the preferred embodiment of the external display apparatus allows a two-level (high and low) signal to be converted to a four-level signal by use of one buffer and two resistances. In addition, additional interface elements to a driving unit are eliminated.

The foregoing embodiments are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

What is claimed is:

1. A display apparatus, comprising:

an application specific integrated circuit (ASIC) having, (a) an integrated circuit, and (b) a converting unit that converts an output signal from the integrated circuit to a plurality of multi-level signals by controlling a current flow, wherein the integrated circuit and the converting unit are disposed in the ASIC; and a display unit that displays respective output values of the ASIC based on the plurality of multi-level signals, and a logic circuit that logically processes the output signal of the integrated circuit; and a plurality of converters each respectively coupled in parallel to the logic circuit, wherein each ofthe plurality of converters receive the output signal and a corresponding enable signal from the integrated circuit and outputs one of (a) the output signal of the integrated circuit and (b) a fraction of the output signal.

2. The apparatus of claim 1, wherein said each of the plurality of converters comprises:

a buffer coupled parallel to the logic circuit;

a first resistance coupled parallel to the buffer; and a second resistance coupled between an output terminal of the buffer and an output terminal of the logic circuit.

3. The apparatus of claims 2, wherein when the buffer is disabled the current flow relative to the first and second resistances is in one of a first direction and a second direction opposite the first direction.

4. The apparatus of claim 2, wherein the first and second resistances are first and second resistors, wherein the first resistor is larger than the second resistor, and wherein the multilevel signals are four-level signals.

5. The apparatus of claim 2, wherein the first and second resistances are equal and the multi-level signals are three-level signals.

6. The apparatus of claim 1, wherein the logic circuit is an inverter.

7. The apparatus of claim 1, wherein the display unit is one of a seven-segment display and a LCD.

8. The apparatus of claim 1, wherein said each of the plurality of converters determine respective levels of a corresponding one of the plurality of multi-level signals.

9. The apparatus of claim 1, wherein the output signal of the application specific integrated circuit and the enable signals are two-level signals.

10. An application specific integrated circuit (ASIC), comprising:

an integrated circuit formed in a first semiconductor chip that performs a prescribed function; and a converting unit that receives a first signal and a plurality of enable signals outputted from the integrated circuit, wherein the converting unit converts the first signal to a plurality of multi-level signals by controlling a current flow, wherein the converting unit comprises, a logic circuit that logically processes the first signal of the integrated circuit; and a plurality of converters each respectively coupled in parallel to the logic circuit, wherein each of the plurality of converters receive the first signal and a corresponding enable signal from the integrated circuit and outputs one of (a) the first signal of the integrated circuit and (b) a fraction of the first signal.

11. The ASIC of claim 10, wherein an inverter that inverts the first signal is the logic circuit, and the first signal is an output signal.

12. The ASIC of claim 10, wherein each of the plurality of converters respectively comprises:

a buffer coupled in parallel to the logic circuit;

a first resistor coupled in parallel to the buffer; and a second resistor coupled between an output terminal of the buffer and an output terminal of the logic circuit.

13. The apparatus of claim 12, wherein when the buffer is disabled the current flow relative to the first and second resistances is in one of a first direction and a second direction opposite the first direction.

14. A display driving apparatus for an application specific integrated circuit, comprising:

a first signal and a plurality of enable signals output by the application specific integrated circuit; and a converting unit that converts the first signal to a plurality of multi-level signals by controlling a current flow, wherein the converting unit comprises, a logic-gate that logically processes the first signal, and a plurality of converters respectively coupled in parallel to the logic-gate to form a plurality of current paths, wherein each of the plurality of converters receive the first signal, and wherein current flow in a selected current path is reversible based on the first signal of the application specific integrated circuit, and wherein each of the plurality of converters receive a corresponding one of the plurality of enable signals and determine respective levels of a corresponding one of the plurality of multi-level signals based on one of the enable signals and the first signal of the integrated circuit.

15. The display driving apparatus of claim 14, wherein the selected current path is enabled based on the corresponding one of the enable signals.

16. The display driving apparatus of claim 15, wherein the selected one of the converters converts the first signal to a four-level signal.

17. The display driving apparatus of claim 16, wherein current flow determines two of the plurality of levels in the multilevel output signal.

18. The display driving apparatus of claims 14, wherein each of the plurality of converters comprises:

a buffer coupled in parallel to the logic-gate;

a first resistor coupled in parallel to the buffer; and a second resistor coupled between an output terminal of the buffer and an output terminal of the logic-gate.

* * * * *